US008469470B2

(12) United States Patent
Hecht et al.

(10) Patent No.: US 8,469,470 B2
(45) Date of Patent: Jun. 25, 2013

(54) REFRIGERATOR UNIT AND/OR A FREEZER UNIT

(75) Inventors: Josef Hecht, Erlenmoos (DE); Monika Albinger, Biberach (DE)

(73) Assignee: Liebherr-Hausgeraete Ochsenhausen GmbH, Ochsenhausen (DE)

( * ) Notice: Subject to any disclaimer, the term of this patent is extended or adjusted under 35 U.S.C. 154(b) by 752 days.

(21) Appl. No.: 11/988,673

(22) PCT Filed: Jul. 18, 2006

(86) PCT No.: PCT/EP2006/007063

§ 371 (c)(1),
(2), (4) Date: Apr. 15, 2008

(87) PCT Pub. No.: WO2007/009753

PCT Pub. Date: Jan. 25, 2007

(65) Prior Publication Data

US 2008/0265734 A1 Oct. 30, 2008

(30) Foreign Application Priority Data

Jul. 19, 2005 (DE) ..... 20 2005 011 357 U
Oct. 27, 2005 (DE) ..... 20 2005 016 883 U

(51) Int. Cl.
*A47B 96/04* (2006.01)

(52) U.S. Cl.
USPC ..... 312/408; 312/410; 312/334.4

(58) Field of Classification Search
USPC ..... 312/408, 410, 404, 334.4, 334.7
See application file for complete search history.

(56) References Cited

U.S. PATENT DOCUMENTS

| | | | | |
|---|---|---|---|---|
| 2,033,859 | A * | 3/1936 | Otte | 312/408 |
| 2,033,860 | A * | 3/1936 | Otte | 312/408 |
| 2,033,861 | A * | 3/1936 | Otte | 312/408 |
| 2,098,198 | A * | 11/1937 | Sindelar | 312/408 |
| 2,276,942 | A * | 3/1942 | Dibble | 108/143 |

(Continued)

FOREIGN PATENT DOCUMENTS

| | | |
|---|---|---|
| AU | 584907 | 6/1989 |
| DE | 3004288 | 8/1981 |
| DE | 8910635 | 11/1989 |
| DE | 4422168 | 1/1995 |
| DE | 4411875 | 5/1995 |
| DE | 29817743 | 2/1999 |
| DE | 10154275 | 5/2003 |
| DE | 202004017136 | 3/2006 |
| EP | 0972468 | 1/2000 |
| EP | 1030146 | 8/2000 |
| WO | WO 9512793 | 5/1995 |

OTHER PUBLICATIONS

ISA EPO, International Search Report of PCT/EP2006/007063, Feb. 7, 2007, WIPO.

*Primary Examiner* — Hanh V Tran
(74) *Attorney, Agent, or Firm* — Alleman Hall McCoy Russell & Tuttle LLP

(57) ABSTRACT

A refrigerator unit and/or a freezer unit having one or more storage shelves for the reception of refrigerated goods and/or frozen goods is provided. The unit has one or more extension arrangements which are connected to the storage shelves and by means of which the storage shelves can be pulled out of and pushed into the appliance, wherein the extension arrangements are releasably connected to the storage shelves and/or wherein the extension arrangements are releasably connected to the unit.

9 Claims, 7 Drawing Sheets

U.S. PATENT DOCUMENTS

| | | | | | |
|---|---|---|---|---|---|
| 2,472,593 | A | * | 6/1949 | King | 312/408 |
| 2,719,772 | A | * | 10/1955 | Petkwitz | 312/408 |
| 2,724,630 | A | * | 11/1955 | Saunders | 312/408 |
| 3,097,901 | A | | 7/1963 | La Flure | |
| 4,470,642 | A | * | 9/1984 | Gasperin | 384/19 |
| 4,610,491 | A | * | 9/1986 | Freeman | 312/291 |
| 4,646,658 | A | * | 3/1987 | Lee | 108/143 |
| 5,340,209 | A | * | 8/1994 | Kolbe et al. | 312/408 |
| 5,735,589 | A | * | 4/1998 | Herrmann et al. | 312/408 |
| 6,076,908 | A | * | 6/2000 | Maffeo | 312/334.7 |
| 6,416,145 | B1 | * | 7/2002 | Singh | 312/334.1 |
| 7,216,646 | B2 | * | 5/2007 | Le et al. | 126/339 |
| 7,568,583 | B2 | * | 8/2009 | Wing et al. | 211/153 |
| 2003/0132691 | A1 | | 7/2003 | Ames | |
| 2003/0173876 | A1 | * | 9/2003 | Fujii et al. | 312/116 |
| 2003/0173882 | A1 | * | 9/2003 | Koons | 312/404 |

* cited by examiner

A-A

C-C

REFRIGERATOR UNIT AND/OR A FREEZER UNIT

CROSS-REFERENCE TO RELATED APPLICATIONS

This is the U.S. National Phase of International PCT Application Serial No. PCT/EP2006/007063 filed Jul. 18, 2006, which in turn claims priority to German Utility Model Application No. 20 2005 016 883.1 filed Oct. 27, 2005, and German Utility Model Application No. 20 2005 011 357.3 filed Jul. 19, 2005, all of which are hereby incorporated by reference in their entirety for all purposes.

BACKGROUND

The present invention relates to a refrigerator unit and/or a freezer unit having one or more storage shelves for the reception of refrigerated goods or frozen goods, with the appliance having one or more extension arrangements which are connected to the storage shelves and by means of which the storage shelves can be pulled out of and pushed into the appliance.

Pull-out storage shelves of refrigerator units and/or freezer units have the substantial advantage with respect to fixedly mounted, non-movable shelves that the refrigerated goods or frozen goods in the rear region of the shelves are comparatively easily accessible even when refrigerated goods and/or frozen goods are located in the front region of the shelves. A clearing away of the front region is thus not absolutely necessary. A disadvantage of previously known storage shelves consists of the fact, however, that the position of the shelves is fixedly set so that the appliances are comparatively inflexible with respect to the adaptability of the inner space to changing needs.

SUMMARY

It is therefore the object of the present invention to further develop a refrigerator unit and/or a freezer unit of the initially named kind such that it enables a more flexible use with respect to previously known appliances.

This object is solved by a refrigerator unit and/or a freezer unit (appliance) comprising having one or more storage shelves for the reception of refrigerated goods or frozen goods, with the appliance having one or more extension arrangements which are connected to the storage shelves and by means of which the storage shelves can be pulled out of and pushed into the appliance. Provision is accordingly made for the extension arrangements to be releasably connected to the storage shelves and/or for the extension arrangements to be releasably connected to the appliance. The advantage can be achieved in this manner that the storage shelves can be installed at different heights in the appliance so that a flexible use of the appliance and an adaptation of the position of the storage shelves to the respectively present needs are possible. Provision can be made in this context for the appliance to have an inner container and for the extension arrangements to be releasably connected to the inner container.

Flexibility with respect to the arrangement of the shelves in the vertical direction is possible in that a plurality of extension arrangements are provided in the vertical direction of the appliance, that is are spaced apart in the vertical direction, and/or in that the extension arrangements can be fixed at a plurality of positions spaced apart in the vertical direction of the appliance. If a plurality of extension arrangements spaced apart in the vertical direction are provided, provision can be made for the storage shelves to be selectively connected to one of these extension arrangements so that the desired vertical adjustment can be made. A vertical adjustability is also produced when the extension arrangements can be fixed in accordance with a preferred embodiment of the invention at a plurality of positions spaced apart in the vertical direction of the appliance.

Provision is made in a preferred embodiment of the invention for the extension arrangements to have a part not moved on the pulling out and pushing in of the shelves and a part movable with the storage shelf and for a locking device to be provided which prevents a displacement of the non-moved part. The extension arrangement can, for example, have an extensible rail which is releasably fastened to the storage shelf and which is displaceable relative to the stationary part of the extension arrangement.

The locking device which prevents the displacement of the non-moved part of the extension arrangement can be made, for example, as a projection which contacts a rib or recess of the inner container in the assembled state of the extension arrangement. In addition to ribs and recesses, any other desired fastening means for the extension arrangement are naturally also conceivable.

It is, for example, possible for the projection to be made as a lug which extends, starting from the extension arrangement, laterally to the adjacent wall of the inner container. It is, for example, conceivable that the lug engages into a recess or pocket or other undercut on the inner container such that the extension arrangement can be adequately loaded and is moreover secured against sliding out or displacement.

It is equally possible for the projection to be made as a lug which has a portion which extends vertically or obliquely downwardly and which engages behind a rib or any other suitable projection arranged at the inner container of the appliance.

In a preferred embodiment of the invention, provision is made for the extension arrangements to be releasably connected to the storage shelves. A plug connection can be provided for this purpose, for example. This plug connection can have a part which is arranged at the storage shelf and which engages into a recess of the extension arrangement. It is, for example, conceivable to clip the extension arrangements to the storage shelves by means of the plug connection. Provision can e.g. be made for the plug connection to have a resilient lug which engages behind the recess in the extension arrangement in the installed state and fixes the storage shelf in this manner.

It is particularly advantageous for the storage shelves to have a raised boundary on one or on a plurality of sides or peripherally, said raised boundary securing the goods on the storage shelves against falling down. The raised boundary can be made, for example, as a peripheral rim or another type of raised portion. It can consist of metal or plastic or comprise one or both of these materials. The raised boundary can be made, for example, in bar shape, as a wire or as a metal sheet. There are no restrictions with respect to the type of raised portion.

In a preferred embodiment of the invention, it is releasably connected to the storage shelves, preferably by means of a plug connection.

Provision can finally be made for the storage shelves to consist of glass or to comprise glass.

A collision can take place between the inner door and the storage shelf in the event that one or more storage shelves are pulled out and the door is closed. To prevent this, provision can be made for a catch for the storage shelf to be arranged preferably at the inner door such that said catch pushes in the storage shelf when the door is closed. The catch can, for example, be made as a skirt which is preferably arranged to the side next to the door storage shelves.

In a further embodiment of the invention, the apparatus, preferably its inner container, has one or more mounts at which or to which the extension arrangements or storage shelves without extension arrangement can lie or be fastened, with the extension arrangements, the storage shelves without extension arrangements and the appliance being made such that the extension arrangements can be replaced with storage shelves without extension arrangements. In this embodiment of the invention, the extension arrangements or rib adapters fastened thereto are made such that the storage shelves with prefitted extensible rails fit (releasably) into appliances or can be replaced as desired with "normal" storage shelves, i.e. storage shelves without an extension arrangement, without anything having to be modified on the appliance, on its inner container or on the mounts or ribs or recesses. This brings along the advantage that an appliance can be retrofitted or converted. There is also the possibility of realizing a combination of normal storage shelves (without extension arrangements) with storage shelves with extension arrangements in one appliance.

The mounts can be made as recesses or as ribs in which or on which the extension arrangements or the storage shelves without extension arrangements lie at least sectionally.

The storage shelves with extensible rails arranged thereon can be made in one piece as a shell made of plastic or as a sheet metal drawn part. These parts manufactured in one part preferably have a shaped rim so that no additional parts are required for the peripheral rim.

BRIEF DESCRIPTION OF THE FIGURES

Further details and advantages of the invention will be explained in more detail with reference to an embodiment shown in the drawing. There are shown.

DETAILED DESCRIPTION OF THE FIGURES

Figure 1:
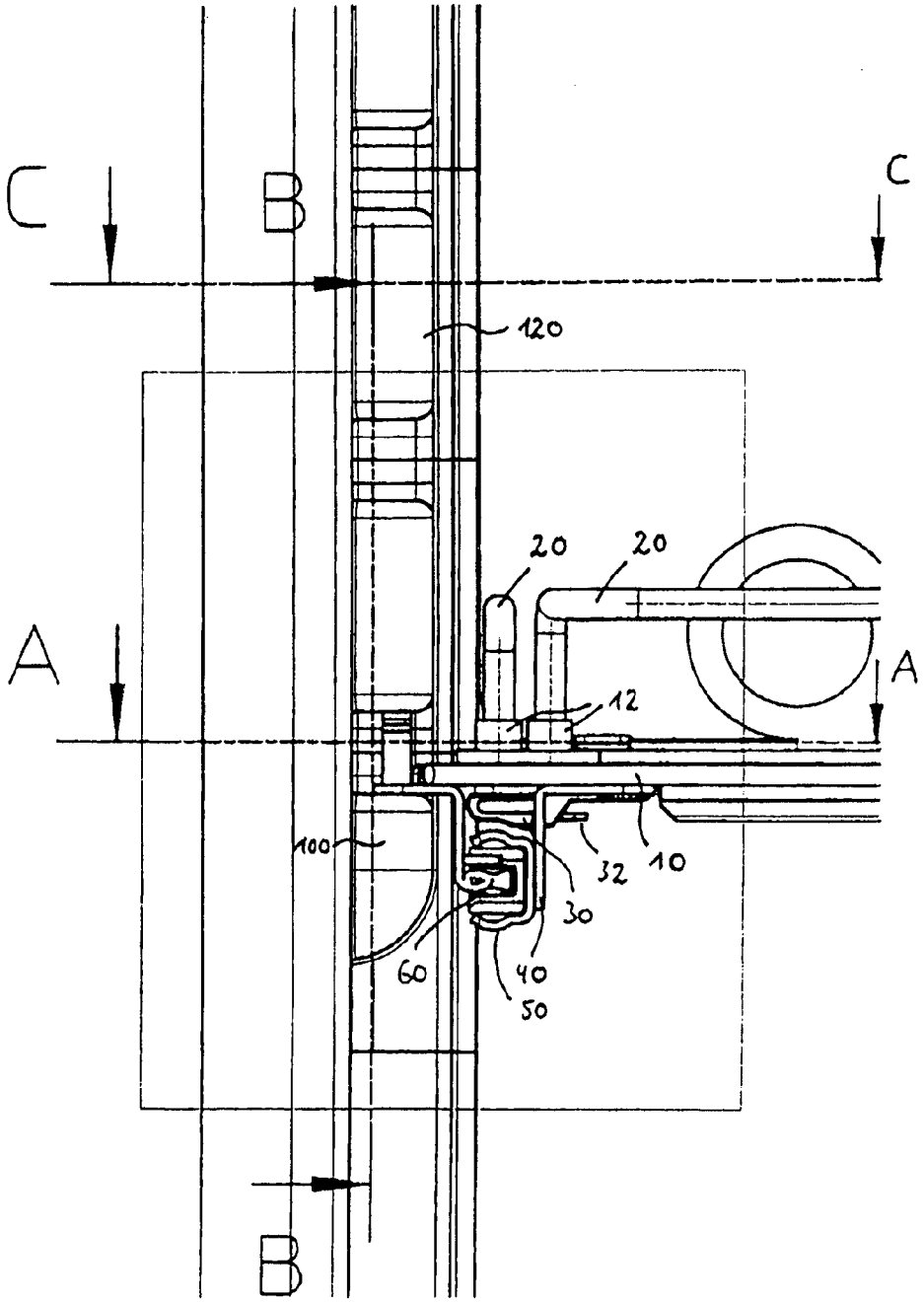
FIG. 1: a part view from the front of the refrigerator and/or freezer unit in accordance with the invention.

FIG. 1 shows in a frontal view a part region of a refrigerator unit and/or a freezer unit in accordance with the invention in which a storage shelf 10 made of glass is arranged. The storage shelf 10 has a banister-like boundary 20 at its upper side, said boundary extending upward from said storage shelf and preventing goods from falling down on a movement of the storage shelf 10. The boundary 20 preferably consists of hoops, for example made of stainless steel, which are connected to the storage shelf 10 by means of a plug connection and which can preferably be removed without tools in order to be able to clean both the boundary 20 and the storage shelf 10. Holders 12 are located on the upper side of the storage shelf 10 and the ends of the bars are received in them.

The plug coupling 30, which has a resilient lug 32, is located on the lower side of the storage shelf 10. The resilient lug 32 extends through a cut-out, not visible in FIG. 1, of the L-shaped hoop 40 which is connected to the movable part 50 of the extension arrangement such that the parts 40 and 50 are likewise moved on the pulling out of the storage shelf 10. The horizontal limb of the hoop 40 supports the storage shelf 10.

The extension arrangement furthermore has a stationary part 60 which is arranged on the inner container of the refrigerator and/or freezer unit such that it is not displaceable in the extension direction of the storage shelf 10. The stationary part 60 of the extension arrangement has a part section which serves as a guide and on which the movable part 50 of the extension arrangement runs, as can be seen from FIG. 1. A vertically standing section adjoins on this part section and merges into a horizontally extending section which lies on a rib 100, with the rib 100 extending inwardly from the inner container of the refrigerator and/or freezer unit, as can be seen from FIG. 1. A vertically downwardly projecting web is located on the horizontally extending section of the part 60 and engages behind the rib 100 and in this manner prevents the fixed part of the extension arrangement from being pushable forwardly.

Figure 2:
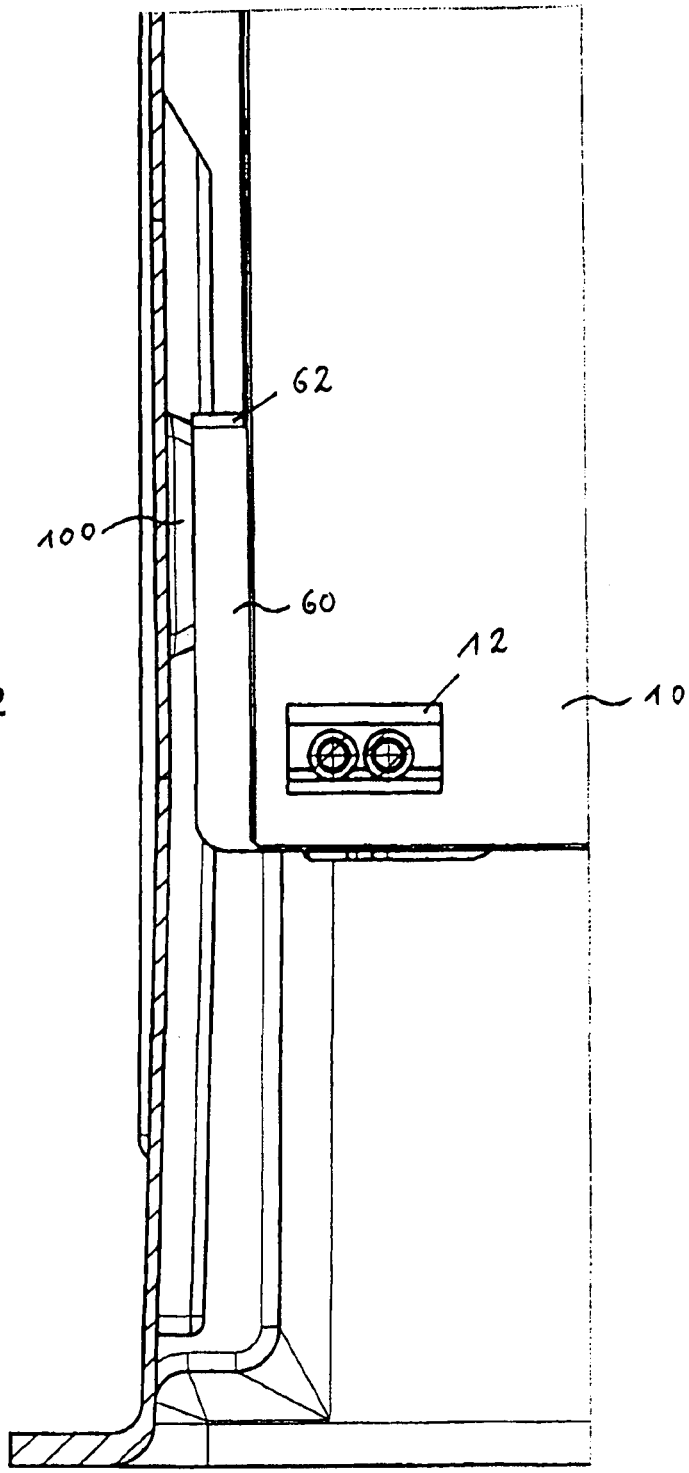
FIG. 2: a sectional representation in accordance with section line A-A in FIG. 1.

The sectional representation in accordance with the sectional line A-A in FIG. 1 is reproduced in FIG. 2. FIG. 2 again illustrates the arrangement of the holder 12 for the bars binding the boundary 20 and located on the upper side of the storage shelf 10. FIG. 2 furthermore illustrates the horizontally extending section of the stationary part 60 of the extension arrangement which lies on the upper side of the rib 100 and which is partly covered by the storage shelf 10, as can be seen from FIG. 1. This section has the vertically downwardly projecting lug 62 which engages behind the rib 100 such that the stationary part 60 cannot be displaced forwardly, that is downwardly in accordance with FIG. 2, but remains at the desired position relative to the inner container of the appliance.

Figure 3:
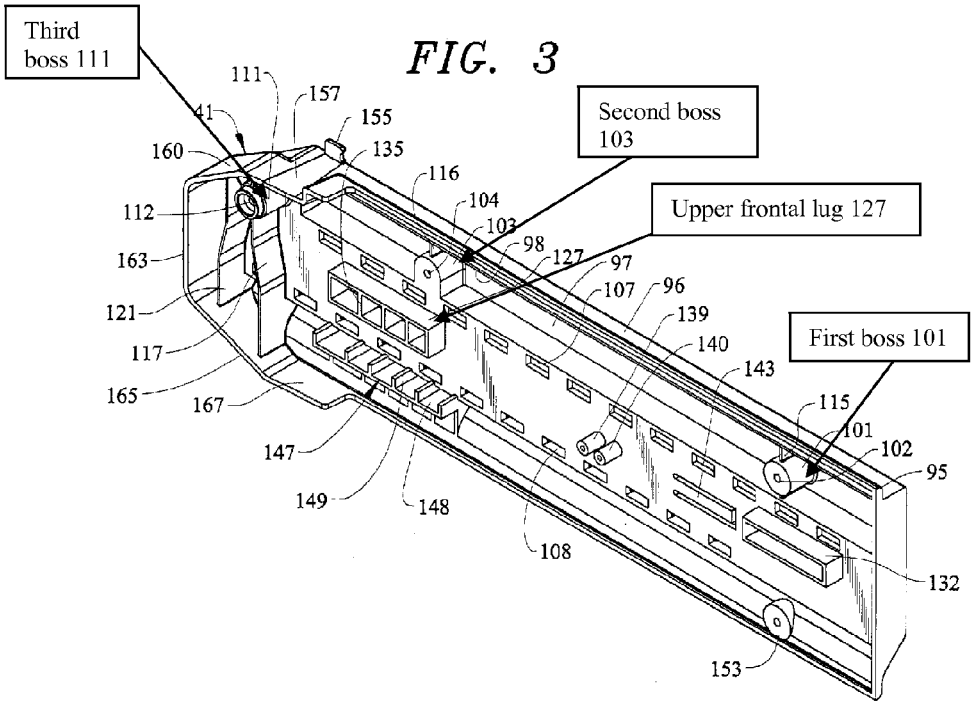
FIG. 3: a sectional representation in accordance with section line B-B in FIG. 1.

The shape of the stationary part 60 of the extension arrangement again becomes clear from the sectional representation in accordance with the sectional line B-B in FIG. 1 which is shown in FIG. 3. This part is supported at the front rib 100 as well as at a rib 110 arranged at a rear region of the inner container. FIG. 3 furthermore again illustrates the vertically projecting lug 62 which engages behind the forward located rib 100 of the inner container at its rear side.

Figure 4:
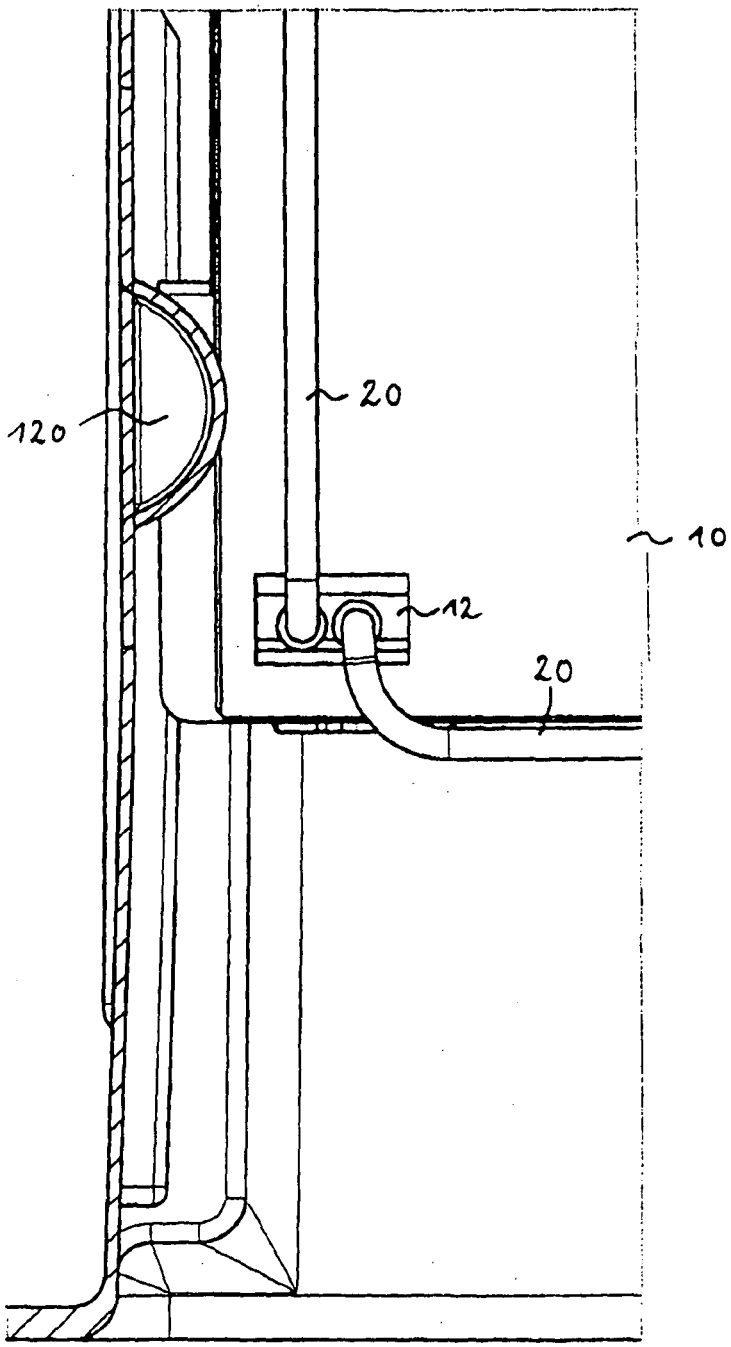
FIG. 4: a sectional representation in accordance with section line C-C in FIG. 1.

A partial plan view of the storage shelf 10 with boundaries 20 located thereon can again be seen from the sectional representation in accordance with line C-C in FIG. 1, which results from FIG. 4. The same parts are here also marked with the same reference numerals as in the preceding and following Figures. Reference numeral 120 also marks the rib which is shown in FIG. 1 and which is spaced apart from the rib 100 in the vertical direction.

As can be seen from the Figures of the present patent application, a plurality of ribs are provided which are spaced apart in the vertical direction and on which the extension arrangement can be placed so that a vertical adjustment of the storage shelves or of the glass plates is possible in a simple manner. If, for example, the storage shelf 10 should be moved upwardly with respect to the position shown in FIG. 1, the stationary part 60 of the extension arrangement can be removed from the ribs 100, 110 and the extension arrangement with the storage shelf 10 can be positioned at another desired position, for example on the rib 120.

Figure 5:
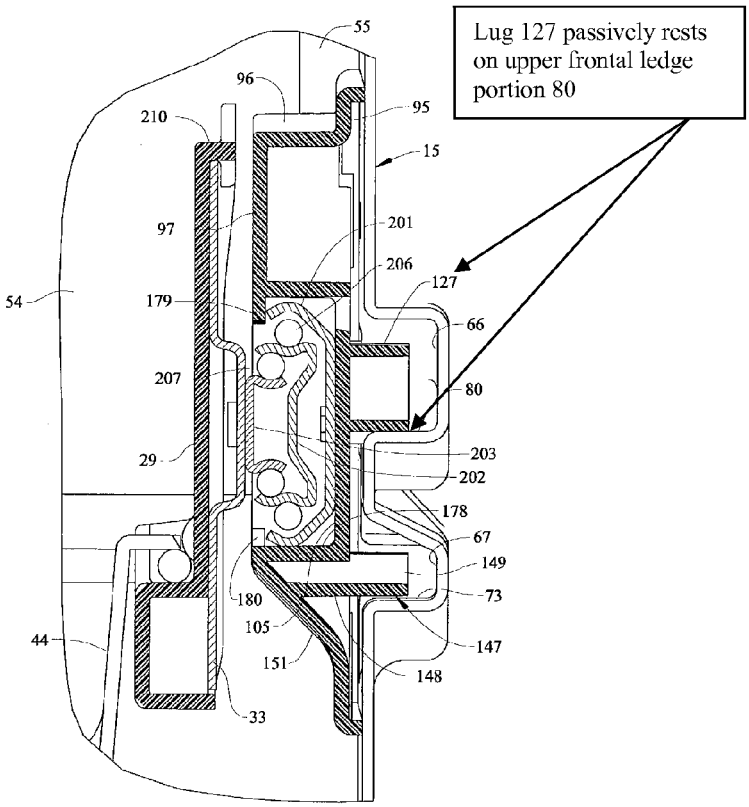
FIG. 5: a perspective part view of the rear region of the inner container with an extension arrangement arranged thereon.

FIG. 5 shows the rear end region of the extension arrangement fixed in a recess 200 of the inner container. The region 200 extends between the rib 110 and the rib arranged thereabove. As can be seen from FIG. 5, the horizontal limb of the stationary part 60 of the extension arrangement lies on the upper side of the rib 110. The initially vertically extending and then horizontally extending lug 61, which contacts the upper boundary of the recess 200 and in this fashion contributes to the fixing of the stationary part 60 relative to the inner container, extends from the horizontal limb.

FIG. 5 furthermore shows the lug 90 which engages over the mounts for the boundary 20 which are located on the upper side of the shelf 10.

Figure 6:
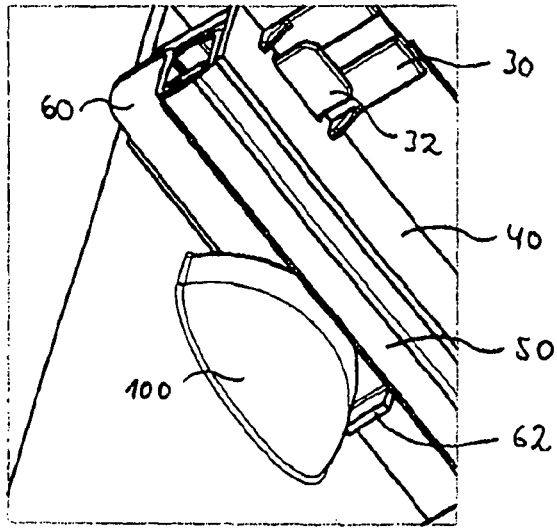
FIG. 6: a perspective part view from below of the extension arrangement arranged on a rib.

The rib 100, on which the stationary part 60 of the extension arrangement lies, can be seen in a perspective view from obliquely below in FIG. 6. Said extension arrangement has the aforementioned lug 62 which engages behind the rib 100, as can be seen from FIG. 6. FIG. 6 furthermore shows the plug connection whose lug 32 projects through a recess of the vertical hoop 40 of the extension arrangement.

Figure 7:
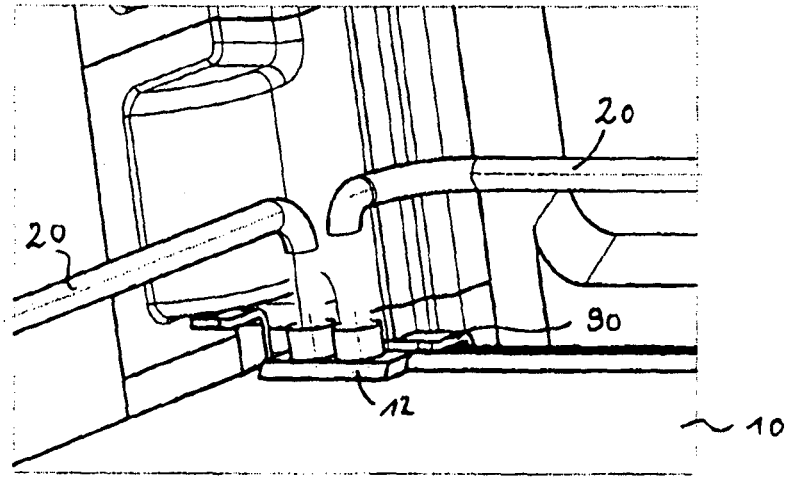
FIG. 7: a perspective part view of the rear region of a storage shelf.

FIG. 7 finally again shows a rear corner region of the storage shelf 10 with boundaries 20 which are arranged thereon and whose holders 12 are fixed by the hoop 90.

Figure 8:
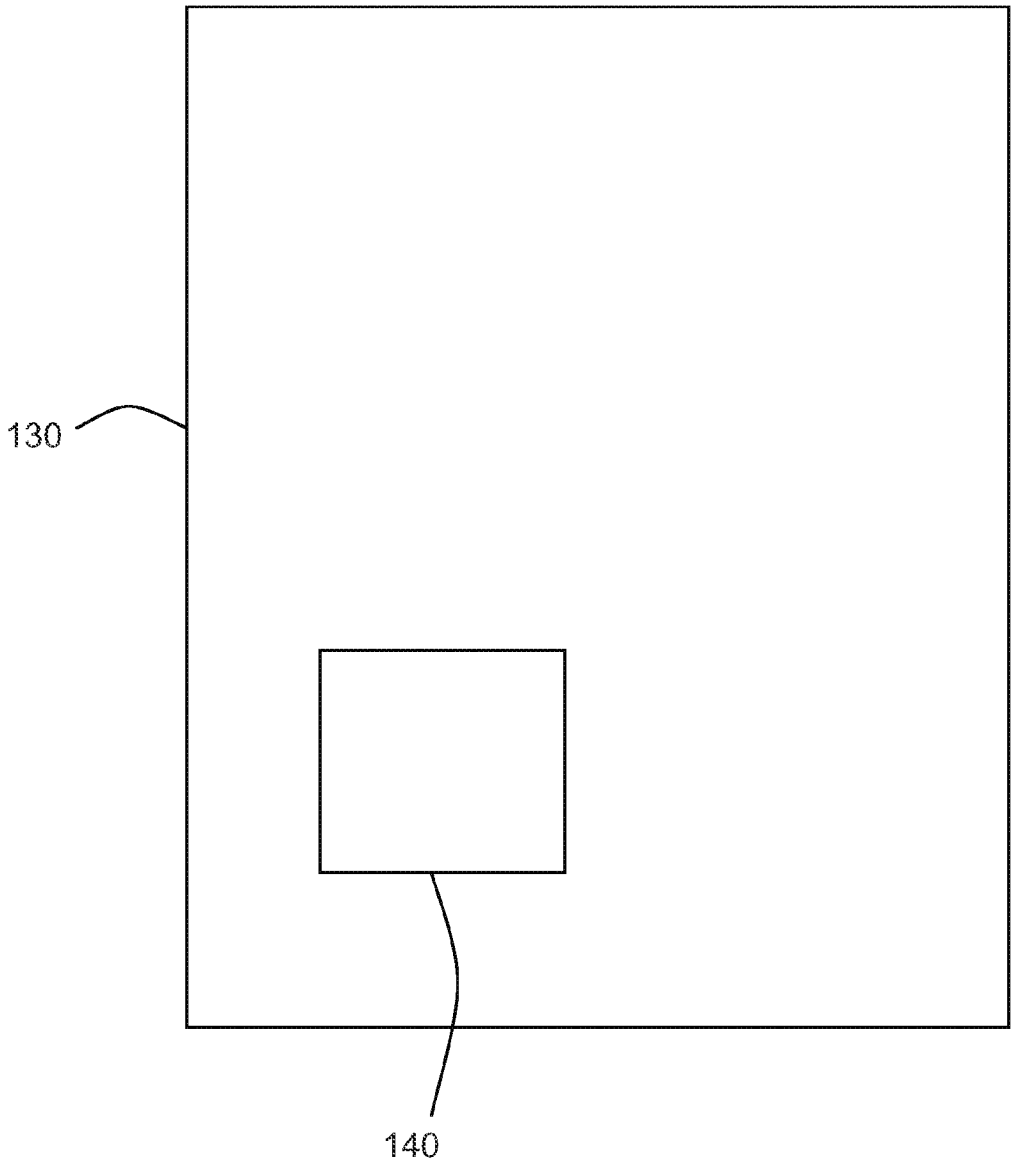
FIG. 8: a rear view of a door of the refrigerator and/or freezer unit with a catch arranged thereon.

The present invention has the advantage that, in a preferred embodiment, the extension arrangements can be clipped onto the glass plates or storage shelves so that they are removable without tools for cleaning. The extension arrangements are then inserted onto ribs or pockets of the inner container with undercuts in a slide-resistant manner. It could be imagined in this context that the inner container has ribs which are present as standard and which could then be used for the vertical adjustment of the glass plates with extensible rails. There is thus the possibility of optionally manufacturing with or without extensible rails without having to change anything on the inner container. There is likewise the possibility of taking out fixedly arranged storage shelves or glass plates and to replace them by extension arrangements so that there is also the possibility of retrofitting. As stated above and as shown in FIG. 8, provision can furthermore preferably be made for a collision to be prevented, in the event that a storage shelf or a glass plate has been pulled out and the door 130 is closed, in that a skirt is attached to the inner door, for example to the side of the door storage shelves, which can act as a catch 140 for the glass plate.

The invention claimed is:

1. A refrigerator unit and/or a freezer unit, comprising:

an inner container including opposing side walls and at least one rib and at least one recess formed on each of the side walls;

one or more storage shelves arranged within the inner container for reception of refrigerated goods or frozen goods;

one or more guide rails which are connected to the storage shelves and by which the storage shelves can be pulled out of the inner container in an extension direction and pushed into the inner container in a direction opposite to the extension direction, the guide rails having a stationary part with a horizontally extending section and a movable part, wherein the movable part is releasably connected to the storage shelves and the stationary part is releasably connected to the inner container;

the at least one rib formed on each of the side walls of the inner container including an upper side on which the horizontally extending section of the stationary part rests in a releasable manner; and a locking device which prevents a displacement of the stationary part in the extension direction, wherein the locking device comprises a lug which extends from the stationary part and contacts an upper boundary of the recess and a projection which extends vertically downwardly from the horizontally extending section of the stationary part and releasably engages behind the at least one rib of the inner container;

wherein the storage shelves can be clipped onto the movable part of the guide rails by a plug connection such that these parts are separable without the use of tools.

2. The refrigerator unit and/or a freezer unit in accordance with claim 1, further comprising a plurality of guide rails spaced apart in a vertical direction; and wherein the guide rails are configured to be fixed at a plurality of positions spaced apart in the vertical direction of the unit.

3. The refrigerator unit and/or a freezer unit in accordance with claim 1, wherein the plug connection has a part which is arranged at the storage shelf and which engages into a recess of the movable part of the guide rails.

4. The refrigerator unit and/or a freezer unit in accordance with claim 1, wherein the storage shelves have a raised boundary on one or more sides or peripherally, said raised boundary securing the goods located on the storage shelves from falling down.

5. The refrigerator unit and/or a freezer unit in accordance with claim 4, wherein the boundary is made of metal or plastic or comprises one or both of these materials.

6. The refrigerator unit and/or a freezer unit in accordance with claim 4, wherein, the boundary is made in a bar shape, as a wire or as a metal sheet.

7. The refrigerator unit and/or a freezer unit in accordance with claim 4, wherein the boundary is connected to the storage shelves releasably by a plug connection.

8. The refrigerator unit and/or a freezer unit in accordance with claim 1, wherein the storage shelves are made of glass or comprise glass.

9. The refrigerator unit and/or a freezer unit in accordance with claim 1, wherein a door of the unit has a catch which is arranged such that it pushes in one or more pulled out storage shelves by closing of the door.

* * * * *

UNITED STATES PATENT AND TRADEMARK OFFICE

CERTIFICATE OF CORRECTION

PATENT NO. : 8,469,470 B2
APPLICATION NO. : 11/988673
DATED : June 25, 2013
INVENTOR(S) : Hecht et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 929 days.

Signed and Sealed this
Eighth Day of September, 2015

Michelle K. Lee

Michelle K. Lee
*Director of the United States Patent and Trademark Office*